United States Patent [19]

Bartolles

[11] Patent Number: 5,054,366

[45] Date of Patent: Oct. 8, 1991

[54] AXIALLY ADJUSTABLE GUN BARREL BASE RING

[75] Inventor: Rolf Bartolles, Korschenbroich, Fed. Rep. of Germany

[73] Assignee: Rheinmetall GmbH, Duesseldorf, Fed. Rep. of Germany

[21] Appl. No.: 528,428

[22] Filed: May 25, 1990

[30] Foreign Application Priority Data

Jul. 7, 1989 [DE] Fed. Rep. of Germany ..... 3922334

[51] Int. Cl.[5] ..... F41A 3/74

[52] U.S. Cl. ..... 89/26

[58] Field of Search ..... 89/26, 24, 17

[56] References Cited

U.S. PATENT DOCUMENTS

| | | | |
|---|---|---|---|
| 1,376,130 | 4/1921 | Asbury | 89/26 |
| 3,355,986 | 12/1967 | D'Andrea | 89/26 |
| 3,420,139 | 1/1969 | Bartels | 89/17 |
| 3,748,958 | 7/1973 | Stearns et al. | 89/26 |
| 3,985,059 | 10/1976 | Politzer et al. | 89/26 |

FOREIGN PATENT DOCUMENTS

| | | | |
|---|---|---|---|
| 251902 | 1/1988 | European Pat. Off. | 89/26 |
| 780565 | 4/1936 | France | 89/26 |
| 16949 | of 1887 | United Kingdom | 89/26 |
| 1094825 | 6/1966 | United Kingdom . | |
| 1273036 | 5/1972 | United Kingdom . | |
| 1465465 | 2/1977 | United Kingdom . | |

OTHER PUBLICATIONS

British Search Report.

*Primary Examiner*—Deborah L. Kyle
*Assistant Examiner*—Stephen Johnson
*Attorney, Agent, or Firm*—Spencer & Frank

[57] ABSTRACT

An arrangement for axially adjusting play between an obturating ring of a gun barrel base ring and a wedge-type breechblock. The base ring has a threaded ring adjustably disposed in an annular groove adjacent the gun barrel for adjusting axial play existing between the obturating ring and the wedge-type breechblock.

6 Claims, 2 Drawing Sheets

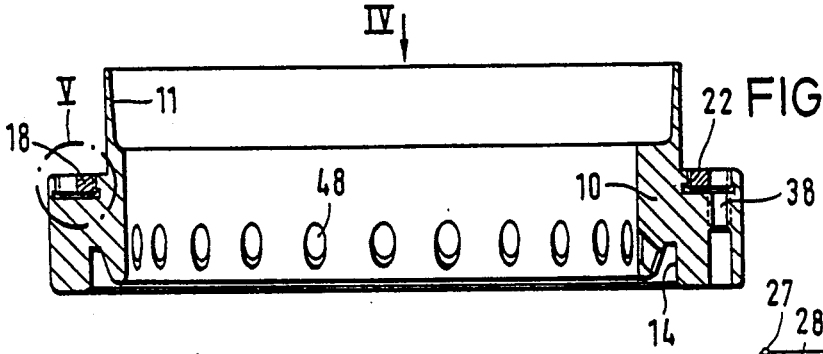
FIG.3
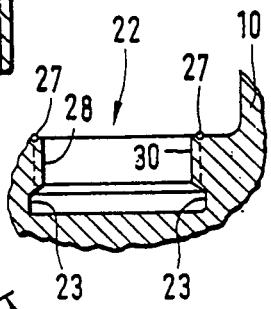
FIG.5
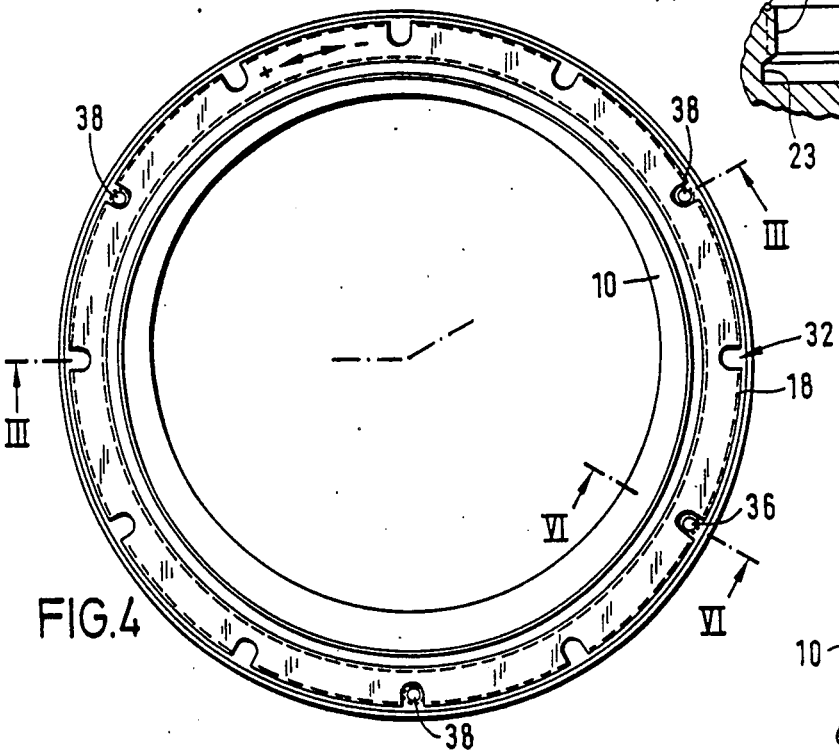
FIG.4
FIG.6
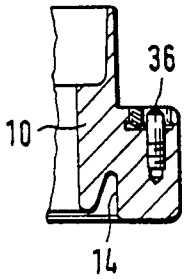
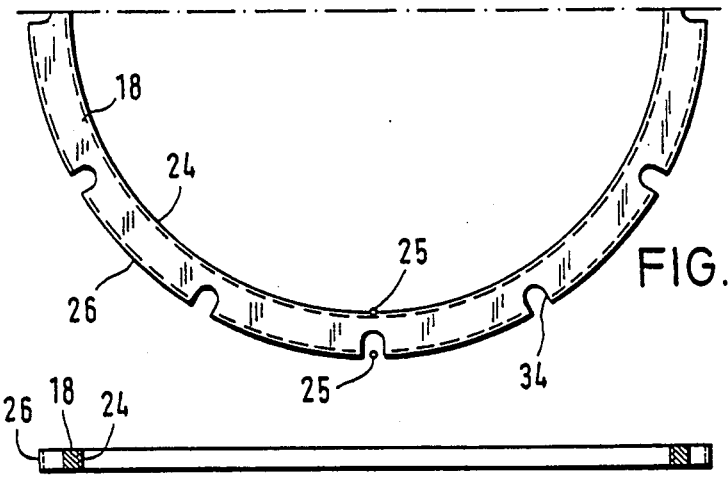
FIG.7
FIG.8

AXIALLY ADJUSTABLE GUN BARREL BASE RING

BACKGROUND OF THE INVENTION

The present invention relates to a gun barrel base ring including an angular obturating ring mounted in a recess and means disposed between the base ring and the gun barrel for adjusting the axial play existing between the obturating ring and a breechblock.

A base ring of this type is disclosed in German Patent No. 1,578,046.A1, with particular reference to FIG. 1 thereof. According to this patent, manufacturing tolerances, particularly of the base ring, the wedge-type breechblock and an insert disposed in the breechblock, are compensated in that means are provided for adjusting the play between the base ring and the gun barrel as needed for the transverse movement of the breechblock. These means comprise twelve spacer rings of different thicknesses which are expensive to manufacture. Depending on the existing manufacturing tolerance, one of these twelve spacer rings is employed while the other eleven rings must be kept in storage near the gun. They are required, for example, for exchange if the base ring or the breechblock insert exhibits wear. It is therefore necessary to constantly check the supply of spacer rings at the gun and, moreover, they require much space in a storage depot.

SUMMARY OF THE INVENTION

It is an object of the present invention to reduce to a minimum the manufacturing and storage costs for the adjustment means required to adjust the necessary play between the obturating ring and the breechblock or the breechblock insert.

The above and other objects are accomplished according to the invention by the provision of an arrangement for axially adjusting play between an obturating ring of a gun barrel base ring and a wedge-type breechblock at the breech end of a gun barrel, including: a gun barrel base ring having first and second frontal faces, the first frontal face being adjacent a wedge-type breechblock of a gun barrel and having a recess opening toward the wedge-type breech block, and the second frontal face being adjacent the gun barrel and having an annular groove opening toward the gun barrel; an angular obturating ring supported in the recess; and a threaded ring adjustably disposed in the annular groove so as to be located between the base ring and the gun barrel for adjusting axial play existing between the obturating ring and the wedge-type breechblock.

By using a basically infinitely adjustable threaded ring, the present invention avoids in an advantageous manner the expensive manufacture of many spacer rings of different thicknesses and the complicated and space consuming storage of the spacer rings employed in the past.

The threaded ring has an internal and an external thread so that the stable position of the threaded ring within the base ring and the absorption of high axial forces that are transferred to the gun barrel is ensured. Moreover, the threaded ring is provided with adjustment means which permit, by simple rotation of the ring, an extremely accurate adjustability of, for example, 0.03 mm.

The adjustment means are configured as grooves which are uniformly distributed over the circumference of the threaded ring and whose free spaces are further advantageously usable for the space saving accommodation of thrust screws.

The present invention will now be described in greater detail with reference to an embodiment that is illustrated in the drawing figures.

BRIEF DESCRIPTION OF THE DRAWINGS

FIG. 3 is a cross-sectional view of the base ring and the adjustment ring as seen along line III—III of FIG. 4.

FIG. 4 is an elevational view in the direction of the arrow IV in FIG. 3.

FIG. 5 shows an enlarged detail of an annular groove of the base ring as indicated at V in FIG. 3.

FIG. 6 is a cross-sectional view along line VI—VI of FIG. 4.

FIG. 7 is a top view of the threaded ring.

FIG. 8 is a cross-sectional view of the threaded ring.

DETAILED DESCRIPTION OF THE PREFERRED EMBODIMENT

Figure 1:
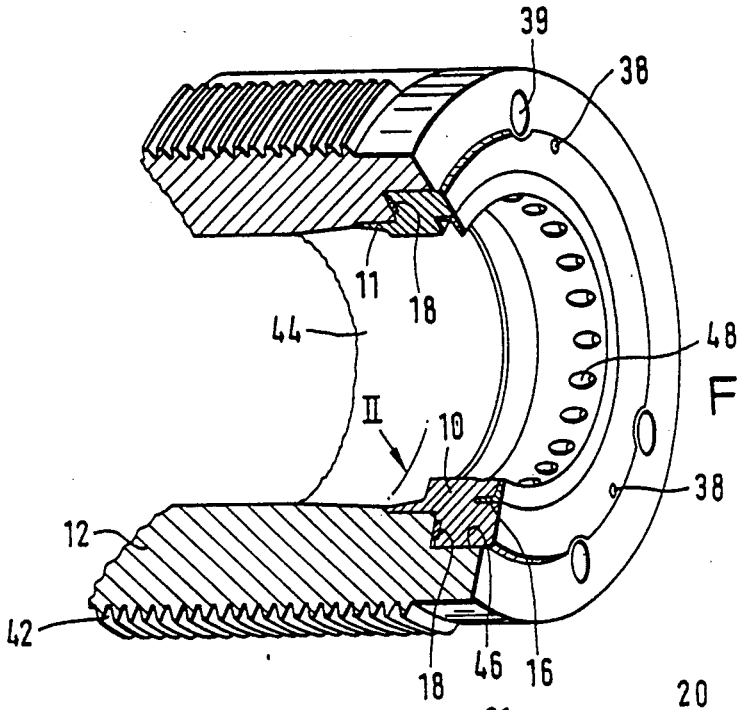
FIG. 1 is a perspective, partial sectional view of the end of a gun barrel provided with a base ring, an obturating ring and an adjustable threaded ring according to the invention.
Figure 2:
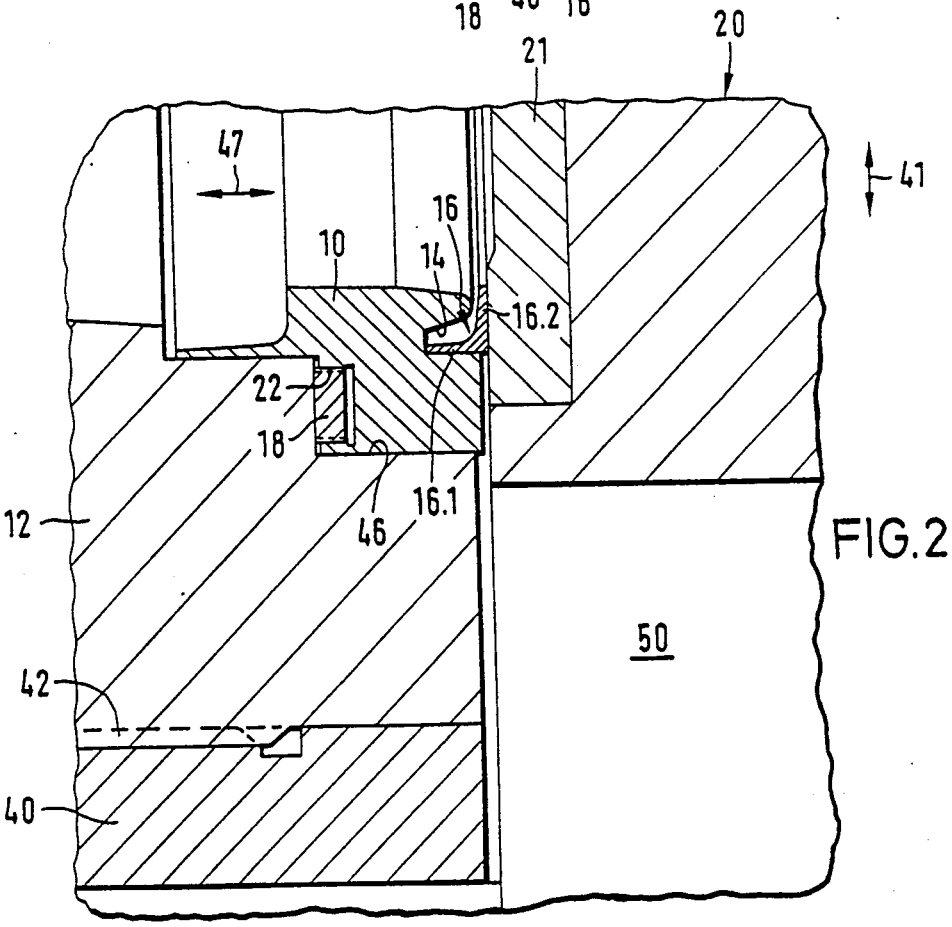
FIG. 2 is an enlargement of a region of the sectional view marked II in FIG. 1 and additionally shows sections of the breech ring and the breechblock.

FIGS. 1 and 2 show the rear end of a gun barrel 12 and the seal region between a breechblock 20 that is transversely displaceable within a breech ring 40 in the direction of arrow 41. A base ring 10 is accommodated by gun barrel 12 and fastened by means of screws 39. Gun barrel 12 additionally includes a thread 42 on its exterior for fastening breech ring 40, and a recess 46 in the interior at the rear end of a charge chamber 44 for accommodating base ring 10.

FIG. 2 shows breechblock 20 in the closed position in which a breechblock insert 21 constitutes the contact surface of an angular obturating ring 16 seated in a recess 14 of base ring 10. Obturating ring 16 has an axially oriented arm 16.1 and a radially oriented arm 16.2. The depth of recess 14 in base ring 10 is less than the length of axially oriented arm 16.1 so that a play of 0.1 mm to 0.2 mm can be set between arm 16.2 of obturating ring 16 extending radially to gun barrel 12 and breechblock insert 21 in order to permit transverse movement of the breechblock wedge by displacement of base ring 10 in the axial direction 47. In the loading position (not shown), a loading channel 50 in breechblock 20 is disposed behind obturating ring 16 so that the ammunition (not shown), that is, projectiles and propelling charges, can be transported into charge chamber 44.

In order for arms 16.1 and 16.2 of obturating ring 16 to be charged with gas pressure for sealing immediately after a shot is fired, recess 14 is connected with charge chamber 44 by means of a plurality of bores 48. On the side of the charge chamber, base ring 10 ends in a narrow obturating lip 11 which lies against the interior of the gun barrel.

As means for adjusting the required axial play between the radial arm 16.2 of obturating ring 16 and breechblock 20 or breechblock insert 21, a threaded ring 18 is disposed within an annular groove 22 facing gun barrel 12 and disposed within base ring 10.

FIGS. 3 to 8 show that the surfaces of the interior bore 24 and of the exterior face 26 of threaded ring 18, and the associated axially extending faces 28 and 30 of annular groove 22 disposed in base ring 10, each are provided with a thread having the same pitch and the same starting point. Due to the fact that threaded ring 18 is provided with threads on both its inner and outer sides, threaded ring 18 becomes highly stressable and is supported without tilting. In particular, the forces acting forwardly onto base ring 10 and to be transferred to the gun barrel can be reliably absorbed by threaded ring 18.

By configuring the interior and exterior threads of threaded ring 18 and annular groove 22 as a fine thread having a pitch in a range between 0.6 mm and 1.5 mm, the required axial play of 0.1 mm to 0.2 mm can be set very precisely and easily between obturating ring and breechblock 20 or breechblock insert 21.

On its circumference, threaded ring 18 is provided with adjustment means 32, for fixing the set play and simultaneously securing threaded ring 18 against rotation. Adjustment means 32 are composed of radially extending grooves 34 disposed in the exterior circumferential surface of threaded ring 18 and which open outwardly in the shape of the letter U. Alternatively, in a manner not shown, adjustment means 32 may be provided in the form of bores. A securing pin 36 screwed into base ring 10 engages in at least one groove or bore 34 and, after adjustment of the axial play, is screwed into the free space of groove or bore 34 to secure the setting of threaded ring 18.

In the illustrated embodiment, adjustment grooves 34 are uniformly distributed over the circumference 12 of threaded ring 18. In one embodiment of threaded ring 18 in which it has a fine thread, for example with a pitch of 1.5 mm, an adjustment step of 0.12 mm can be realized and for a fine thread having a pitch of 0.6 mm an adjustment step of 0.05 mm can be realized with a rotation of the threaded ring between one groove 34 and the next. By increasing the number of adjustment grooves 34 on threaded ring 18, the setting accuracy for adjustment of the ring can be made even more precise. Thus, with 24 grooves and a pitch of 0.6 mm, it is possible to realize adjustment accuracies of 0.03 mm, and for a pitch of 1.5 mm, adjustment accuracies of 0.06 mm can be realized. With a fine clockwise thread, the distance from gun barrel 12 decreases when threaded ring 18 is turned clockwise so that the play to be set between obturating ring 16 and the breechblock becomes greater. For rotation in the opposite direction, the play to be set becomes correspondingly smaller.

In order to ensure a secure force transmission, threaded ring 18 has such a thickness that at least four supporting thread turns are screwed into annular groove 22.

The fine thread disposed on faces 28 and 30 within annular groove 22 ends in a groove enlargement 23 whose corners are rounded in order to reduce a notch effect.

Threaded ring 18 can still be adjusted with ease even after longer periods of use because its arrangement is protected against powder gases by sealing lip 11 and obturating ring 16.

In order to ensure that ring 18 is screwed uniformly into annular groove 22, the respective interior and exterior fine threads of ring 18 begin at the same point 25 and the fine threads disposed on faces 28 and 30 of annular groove 22 also begin at the same point 27.

As shown in FIGS. 1, 3 and 4, base ring 10 can easily be released from recess 46 of gun barrel 12 by preferably three thrust screws 38 distributed over the circumference. Thrust screws 38 require no further passage through threaded ring 18 for the thrusting process because the free space of grooves 34 can be utilized to advantage for this purpose.

Obviously, numerous and additional modifications and variations of the present invention are possible in light of the above teachings. It is therefore to be understood that within the scope of the appended claims, the invention may be practiced otherwise than as specifically claimed.

What is claimed is:

1. An arrangement for axially adjusting play between an obturating ring and a wedge-type breechblock at the breech end of a gun barrel, comprising:

a gun barrel base ring for the breech end of the gun barrel, said base ring including a first frontal face for disposition adjacent the wedge-type breechblock of the gun barrel and having a recess opening toward the wedge-type breechblock, and a second frontal face for disposition adjacent the gun barrel and having an annular groove opening toward the gun barrel;

an angular obturating ring supported in the recess of the first frontal face of said base ring; and a threaded ring adjustably disposed in the annular groove of the second frontal face of said base ring so as to be located between said base ring and the gun barrel for adjusting axial play between said obturating ring and the wedge-type breechblock;

wherein said threaded ring has an exterior circumferential surface and an inner face defining a bore through said threaded ring; said base ring has axially extending faces defining the annular groove in which said threaded ring is disposed; and the exterior circumferential surface and said inner face of said threaded ring and the axially extending faces of said annular groove are each provided with a thread having the same pitch and the same starting point.

2. An arrangement as defined in claim 1, wherein the respective threads of said threaded ring and of said axially extending faces of the annular groove comprise fine threads.

3. An arrangement as defined in claim 2, wherein each said fine thread has a pitch in a range from 0.6 mm to 1.5 mm.

4. An arrangement as defined in claim 3, and further comprising setting means disposed at the exterior circumferential surface of said threaded ring for permitting setting of the axial play within a range from 0.3 mm to 1.2 mm.

5. An arrangement as defined in claim 4, wherein said setting means comprises radially extending grooves disposed on the exterior circumferential surface of said threaded ring which open in a shape of a letter U, and a securing pin disposed in at least one groove of said radially extending grooves to be screwed into said base ring.

6. An arrangement as defined in claim 5, and further comprising a plurality of thrust screws distributed over the circumference of the base ring so a to extend into radially extending grooves not occupied by said securing pin for releasible attaching said base ring to the gun barrel.

* * * * *